US006799844B2

(12) United States Patent
Leighton et al.

(10) Patent No.: US 6,799,844 B2
(45) Date of Patent: Oct. 5, 2004

(54) HIGH SHEAR BALL CHECK VALVE DEVICE AND A LIQUID INK IMAGE PRODUCING MACHINE USING SAME

(75) Inventors: Roger Leighton, Rochester, NY (US); S. Warren Lohr, Sleepy Hollow, NY (US)

(73) Assignee: Xerox Corporation, Stamford, CT (US)

( * ) Notice: Subject to any disclaimer, the term of this patent is extended or adjusted under 35 U.S.C. 154(b) by 25 days.

(21) Appl. No.: 10/320,854

(22) Filed: Dec. 16, 2002

(65) Prior Publication Data

US 2004/0114000 A1 Jun. 17, 2004

(51) Int. Cl.[7] ..... M41J 2/175
(52) U.S. Cl. ..... 347/86; 347/88
(58) Field of Search ..... 347/85, 86, 87, 347/88, 99; 137/247.13, 247.21, 247.23, 247.25, 384, 449

(56) References Cited

U.S. PATENT DOCUMENTS

| | | | | |
|---|---|---|---|---|
| 3,620,653 A | * | 11/1971 | Gaylord et al. | 417/568 |
| 3,797,521 A | * | 3/1974 | King | 137/858 |
| 4,593,292 A | * | 6/1986 | Lewis | 347/88 |
| 4,631,557 A | * | 12/1986 | Cooke et al. | 347/88 |
| 4,636,803 A | | 1/1987 | Mikalsen | 346/1.1 |
| 4,641,154 A | * | 2/1987 | Mikalsen | 347/88 |
| 4,739,339 A | | 4/1988 | DeYoung et al. | 346/1.1 |
| 4,814,786 A | * | 3/1989 | Hoisington et al. | 347/88 |
| 5,038,157 A | | 8/1991 | Howard | 346/140 R |
| 5,372,852 A | | 12/1994 | Titterington et al. | 427/288 |
| 6,053,608 A | | 4/2000 | Ishii et al. | 347/88 |
| 6,183,074 B1 | * | 2/2001 | Miyashita et al. | 347/85 |
| D453,787 S | | 2/2002 | Mattern | D18/56 |
| 6,394,593 B1 | * | 5/2002 | Komplin et al. | 347/86 |

FOREIGN PATENT DOCUMENTS

EP 042643 A 2/1991

* cited by examiner

*Primary Examiner*—Anh T. N. Vo
(74) *Attorney, Agent, or Firm*—Tallam I. Nguti

(57) ABSTRACT

A high shear ball check valve device is provided and is suitable for use in a liquid ink image producing machine to quickly and precisely control flow of liquid ink. The high shear ball check valve device includes a valve housing defining a valve chamber. The valve chamber has a desired cross-dimension, an inlet end, and an outlet end. The high shear ball check valve device also includes an inlet member that is connected to the inlet end of the valve housing and has an inlet opening and a ball seat and seal portion surrounding the inlet opening. The ball seat and seal portion has a desired first durometer hardness value. The high shear ball check valve device next includes a valve ball having a desired diameter and being located movably within the valve chamber, and an outlet opening located at the outlet end of the valve chamber. The outlet opening has a rectangular shape, and a size that is slightly greater than the diameter of the valve ball, for creating a backward fluid flow pattern that results in relatively high shear stress on the valve ball. The relatively high shear stress thereby quickly moves the valve ball away from the outlet opening and back against the ball seat and seal portion to shut off the inlet opening.

20 Claims, 6 Drawing Sheets

HIGH SHEAR BALL CHECK VALVE DEVICE AND A LIQUID INK IMAGE PRODUCING MACHINE USING SAME

RELATED CASE

This application is related to U.S. application Ser. No. 10/320,819 entitled "SOLID PHASE CHANGE INK MELTER ASSEMBLY AND PHASE CHANGE INK IMAGE PRODUCING MACHINE HAVING SAME"; and U.S. application Ser. No. 10/320,820 entitled "PHASE CHANGE INK MELTING AND CONTROL APPARATUS AND METHOD AND A PHASE CHANGE INK IMAGE PRODUCING MACHINE HAVING SAME"; and U.S. application Ser. No. 10/320,853 entitled "SOLID PHASE CHANGE INK PRE-MELTER ASSEMBLY AND A PHASE CHANGE INK IMAGE PRODUCING MACHINE HAVING SAME", each of which is being filed herewith on the same day and having at least one common inventor.

BACKGROUND OF THE INVENTION

This invention relates generally to valve devices, and more particularly to a high shear ball check valve device and a liquid ink image producing machine having same.

Prior art valve devices, including ball type check valves devices which will "check" the reverse flow of fluid through a flow line are well known. One typical problem with these prior art valve devices is that they are usually designed for high pressure applications with gravity or a spring return device on the flapper or a ball sealing member. As such, they are not very functional for ultra-low pressure actuation applications because they do not respond quickly and precisely to changes in low pressure flow condition, and do not provide for good sealing under such conditions. The inability of prior art valve devices to respond quickly and precisely to flow control or to changes in flow conditions, makes their use unacceptable for controlling liquid ink flow liquid ink image producing machine, for example a phase change ink image producing machine.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops. Such molten ink ordinarily needs to be transported and controlled precisely, by devices including a check valve for example, between a melting station and such printhead device.

An example of such a phase change ink image producing machine or printer, and the process for producing images therewith onto image receiving sheets is disclosed in U.S. Pat. No. 5,372,852 issued Dec. 13, 1992 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them the image receiving substrate, and fixing the phase change ink to the substrate.

Conventionally, the solid form of the phase change is a "stick", "block", "bar" or "pellet" as disclosed for example in U.S. Pat No. 4,636,803 (rectangular block, cylindrical block); U.S. Pat. No. 4,739,339 (cylindrical block); U.S. Pat. No. 5,038,157 (hexagonal bar); U.S. Pat. No. 6,053,608 (tapered lock with a stepped configuration). Further examples of such solid forms are also disclosed in design patents such as U.S. Pat. No. D453,787 issued Feb. 19, 2002. In use, each such block form "stick", "block", "bar" or "pellet" is fed into a heated melting device that melts or phase changes the "stick", "block", "bar" or "pellet" directly into a print head reservoir for printing as described above.

Conventionally, phase change ink image producing machines or printers, particularly color image producing such machines or printers, are considered to be low throughput, typically producing at a rate of less than 30 prints per minute (PPM). The throughput rate (PPM) of each phase change ink image producing machine or printer employing solid phase change inks in such "stick", "block", "bar" or "pellet" forms is directly dependent on how quickly such a "stick", "block", "bar" or "pellet" form can be melted down into a liquid. The quality of the images produced depends on such a melting rate, and on the subsystems and devices such as flow control check valves, employed to control the phase change ink liquid.

There is therefore a need for an efficient and fast responsive check valve device, and one that is suitable for use in the controlling of liquid ink flow in a liquid ink image producing machines.

SUMMARY OF THE INVENTION

In accordance with the present invention, there is provided a high shear ball check valve device that is suitable for use in a liquid ink image producing machine to quickly and precisely control flow of liquid ink. The high shear ball check valve device includes a valve housing defining a valve chamber. The valve chamber has a desired cross-dimension, an inlet end, and an outlet end. The high shear ball check valve device also includes an inlet member that is connected to the valve housing and has an inlet opening and a ball seat and seal portion surrounding the inlet opening. The ball seat and seal portion has a desired first durometer hardness value. The high shear ball check valve device next includes a valve ball having a desired diameter and being located movably within the valve chamber, and an outlet opening located at the outlet end of the valve chamber. The outlet opening has a rectangular shape, and a size that is slightly greater than the diameter of the valve ball, for creating a backward fluid flow pattern that results in relatively high shear stress on the valve ball. The relatively high shear stress thereby quickly moving the valve ball away from the outlet opening and back against the ball seat and seal portion to shut off the inlet opening.

BRIEF DESCRIPTION OF THE DRAWINGS

In the detailed description of the invention presented below, reference is made to the drawings, in which.

DETAILED DESCRIPTION OF THE INVENTION

Figure 1:
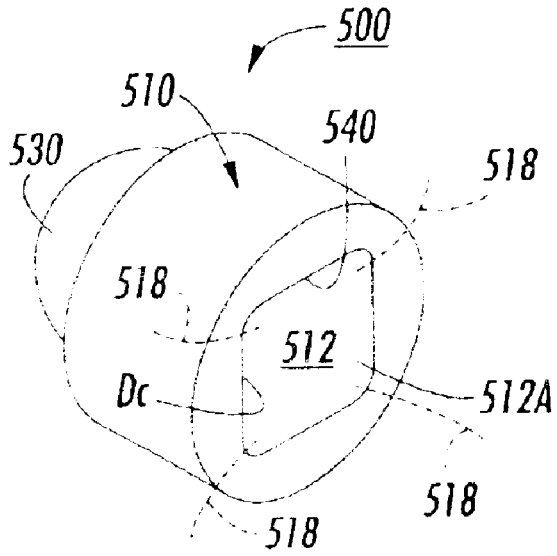
FIG. 1 is a perspective schematic of the high shear ball check valve device of the flow control assembly of the present invention showing the square exit opening thereof.
Figure 2:
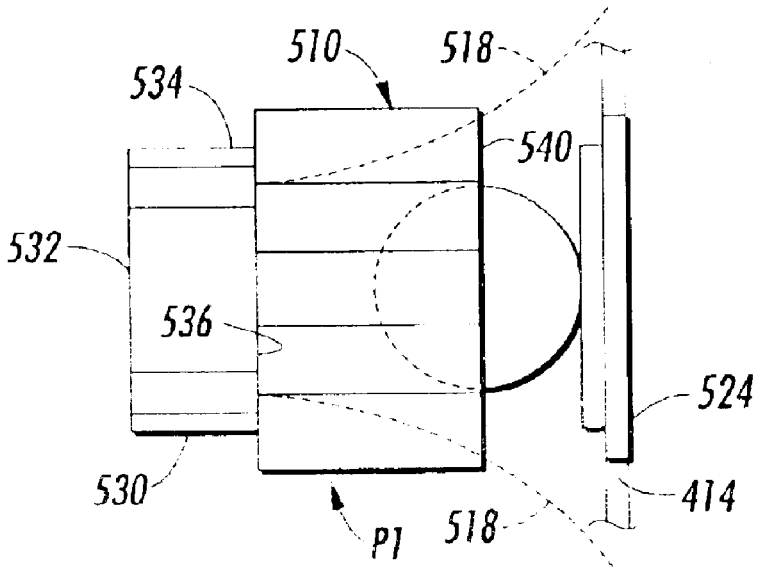
FIGS. 2 and 3 are illustrations of the open and closed positions of the high shear ball check valve device in accordance with the present invention.
Figure 3:
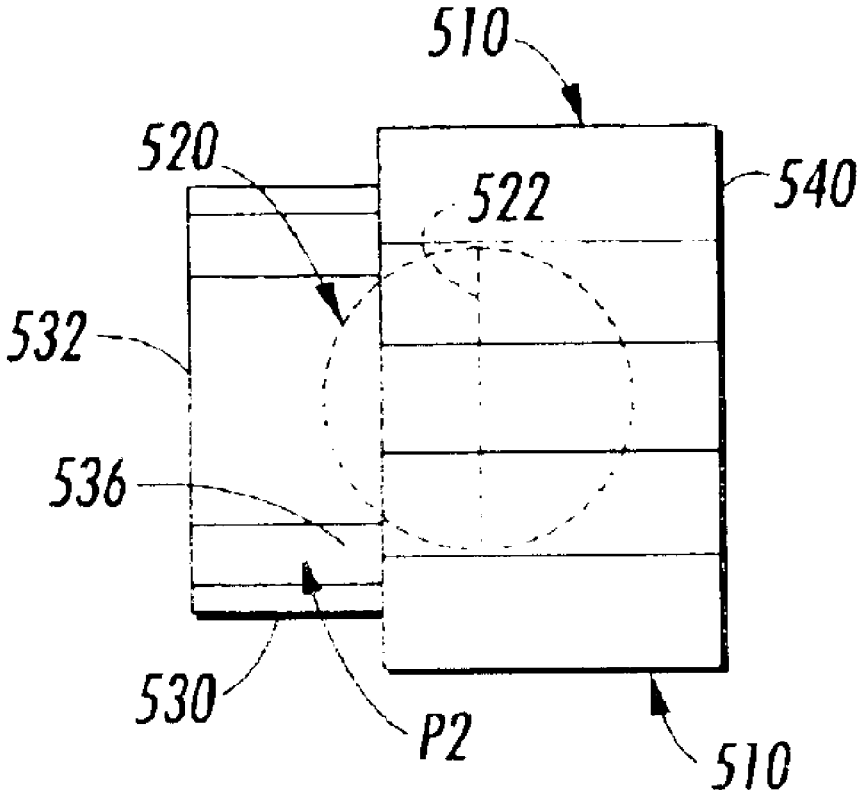
Figure 4:
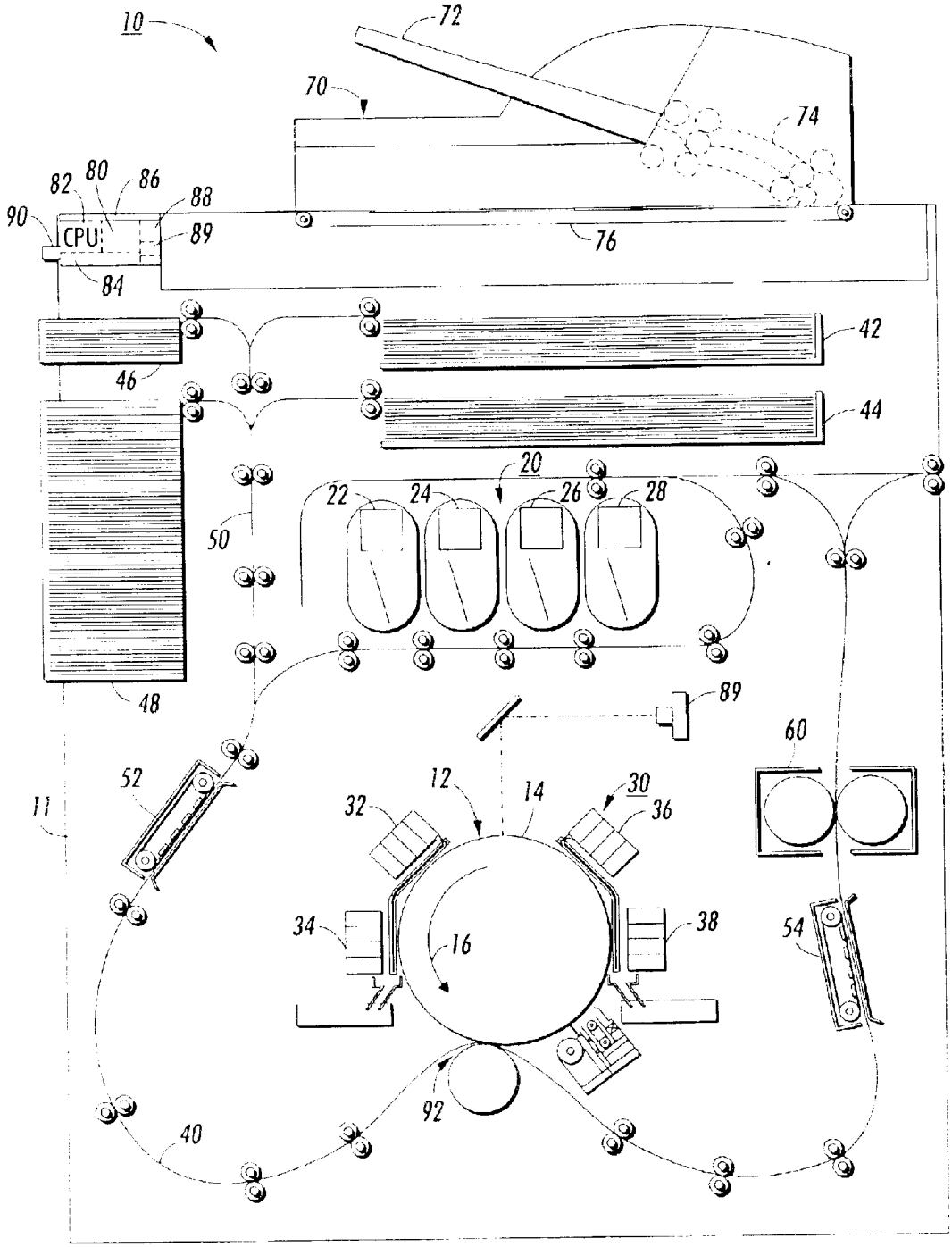
FIG. 4 is a vertical schematic of the high-speed phase change ink image producing machine or printer including the flow control assembly of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Referring now to FIGS. 1–4 and 6–7, the high shear ball check valve device 500 and flow control assembly 450 of the present invention are further illustrated in greater detail. As shown, the flow control assembly 450 includes the high shear check valve device 500 located between the low pressure reservoir 404 and the high pressure reservoir 414, and a back pressurization means 460 for producing back flow pressure in the high pressure reservoir 414. The high shear ball check valve device 500 functions to permit molten liquid phase change ink (molten liquid ink) to flow in only one direction from the low pressure reservoir 404 to the high pressure reservoir 414 and beyond, while preventing reverse flow back into the low pressure reservoir.

In summary, the high shear ball check valve device 500 includes a valve housing 510 defining a valve chamber 512. The valve chamber has a desired cross-dimension 512A, an inlet end including an inlet opening 532, and an outlet end including an outlet opening 540. The high shear ball check valve device 500 also includes an inlet member 530 that is connected to the valve housing 510 and has the inlet opening 532, a ball seat and seal portion 534, and ball seat and seal 536 surrounding the inlet opening 532. The ball seat and seal portion 534 has a desired first, low durometer hardness value. The high shear ball check valve device 500 next includes a valve ball 520 located movably within the valve chamber 512. The outlet opening 540 has a rectangular shape, for example a square shape, for allowing fluid pass over and through opening corners around the valve ball, thus creating relatively high shear stress on the valve ball 520. When the high pressure side or source is energized for shutting off the check valve, a similar backward fluid flow pattern results in relatively high shear stress on the valve ball 520, thereby quickly moving the valve ball 520 away from the outlet opening 540 and back against the ball seat and seal 536 to shut off the inlet opening 532.

In detail, the ball check valve device 500 includes a valve housing 510, a high durometer fluorocarbon ball 520, and an inlet opening 532 of a low durometer silicone feed tube inlet member 530 through which molten liquid ink flows (from the LPR 404) into the valve housing 510. The valve ball 520 is relatively lightweight to allow low pressure actuation, and so has a relatively low density that is less than that of the molten liquid ink allowing it to float freely within molten liquid ink within the valve housing 510 and downstream of the valve seat and seal 536. The valve ball 520 is made for example of a fluoroelastomer having a second, relatively higher durometer hardness value. It also has a slightly larger diameter than that of the inlet opening 532. The inlet opening 532 of the feed tube 530 functions as the valve seat and seal 536 for the high durometer ground fluorocarbon ball 520. The valve body or housing 510 has a rectangular cross-section 512A and square fluid outlet 540 that affect molten liquid ink flow, thus creating a high pressure gradient on the ball 520 because of the corner flow pattern 518. The high pressure gradient on the ball eliminates the need for a return spring for returning the ball to its seat and seal 536 within the valve housing. The valve seat and seal 536 includes a sharp, clean cut edge on the inside diameter side of the opening 532 for preventing against leaks and assuring low pressure sealing conditions. The inlet member 530 is made of a material that will not swell due to liquid wetting or high operating temperatures. The seat and seal 536 is designed to work within a low pressure range of from about 4 PSI (back pressure from the back pressurization means 460) to about 0 PSI decreasing pressure. This thus allows to continue to function in the forward flow direction as the heights of liquid in a container downstream and one upstream level or equalize.

In the machine 10, when refill ink is demanded by a printhead assembly 32, 34 (FIG. 1) for a particular color ink, a solenoid valve 462 (FIG. 7) and an air pump 464 of the back pressurization means 460 are actuated via conduits 466, to supply about 4–5 PSI of air pressure. Such pressure is supplied into an isolated segment 414A, 414B, 414C or 414D of the high pressure reservoir 414 that contains such particular color ink. The 4–5 PSI air pressure forces molten liquid ink within the segment downwards for initial backward flow into the rectangular (square) outlet opening 540 of the ball check valve device 500. It simultaneously also forces such ink into and through the particular one of the discharge openings 419A, 419B, 419C, 419D (one for each color ink CYMK) (FIG. 6), into a particular filter segment (not shown) of the filter assembly 420.

During such initial backward flow, the normal square outlet opening 540 of the ball check valve device 500 produces a rectangular flow pattern 518 that immediately engulfs the ball 520 symmetrically on all four corners inducing in it a backward velocity from the stop cap 524. By design, the distance "x" for ball travel from the stop cap 524 or thereabout, to the ball seat and seal 536 is made relatively short, being 2 mm or less. As a consequence a relatively and significantly high shear rate (velocity/distance) is generated in the ball 520 quickly forcing it back into the valve closed position P2 against its silicone rubber seat and seal 536, resulting in a ball seal. The pressure gradient over the ball was sufficient to overcome ball mass, and the closure or seal force was 112 gm against the seat and seal.

The ball seating and sealing as such thus quickly and immediately shuts off both forward flow from the low pressure reservoir and backward flow into the valve housing from the high pressure reservoir 414. Simultaneously however, the "ball seal" redirects all the high pressure towards forward and precise flow of molten liquid ink from the high pressure reservoir 414 into the filter assembly, thus forcing ink through the filter assembly 420 and towards the printhead system 30. Because of the relatively high shear rate, the 4–5 PSI supply pressure causes the ball 520 to close or create the ball seal in less than about 10 micro-seconds, with less than 10 mg of ink back wash.

In the valve open position P1, the minimum ink flow rate from the low pressure reservoir through the valve housing is about 80 ml/min, which is equivalent to about 200 Lohms orifice restriction at 1 inch H2O pressure. The flow rate as such is suitable for enabling a 5-second refresh time to level the height of liquid ink between the low pressure and high pressure reservoirs.

The input member 530 for example can be a soft silicone rubber tube 530 having a relatively soft durometer hardness value of about 40 shore A. The discharge end 531 of the silicone rubber tube 530 which is located within the valve chamber 512 and which includes the inlet opening 532, forms the seat and seal 536 for the valve ball 520. As such, the end portion 534 must have a clean cut to it for creating a good low pressure seal against the ball 520 in the valve closed position P2.

The valve ball 520 is made of a fluorocarbon material such as fluoroelastomer (VITON, trademark of DuPont) having a desired second durometer hardness value of about 85 shore A that is greater than that of the soft silicone rubber tube 530. The rectangular, that is square, cross-section 512A of the valve chamber 512 is suitable for creating corner flow patterns that force the molten liquid ink to flow around the ball and through the corners of a square hole or chamber 512.

The diameter 522 (for example 0.218 inch) of the valve ball 520 is made slightly less than the cross-dimension 512A (for example 0.230 inch) of the square valve chamber 512. This therefore allows only a very narrow flow path of about 0.006 inch on opposite sides (e.g. top and bottom) of the ball. As such, during an initial backward flow, the narrow flow paths, (for example at the top of the ball) will each create a high pressure gradient and large shear stresses on the ball. This quickly forces the ball 520 from the stop cap 524 (mounted in a back plate of the high pressure reservoir) back to the closed valve position against its seat and seal 536.

On the inlet side from the low pressure reservoir 404, the inlet opening 532 on the low pressure side of the valve housing is about 3 mm in diameter. The height of liquid ink in the low pressure reservoir is sufficient to produce about 1.5 inch water pressure for moving the valve ball 520 away from the valve closed position P2 (against its seat and seal 536). This thus allows ink to flow around the corners of the square cross-section 512A of the valve housing 510. The valve ball 520 has a diameter of about 5.5 mm, within a valve chamber 512 having a height Dc and width Dc that are each slightly greater than diameter 522 of ball 520, thus resulting in a significantly large corner geometry for a Lohm flow resistance of under 200 Lohms.

On the outlet side of the high pressure, actuation of the back pressurization means 460 is necessary as described above. When these are activated and produce for example 4 PSI, a high shear flow around the ball in the corners of the rectangular housing 510 is created. The pressure gradient (from the square outlet 540 and within such a rectangular housing 510) is such that about 90% of the applied pressure (4 PSI) is on the ball 520. This creates a relatively high shear rate and quickly pushing the ball 520 back from the valve open position P1 (against the stop cap 524) into the valve closed position P2 against its soft silicone rubber seat and seal 536.

Figure 5:
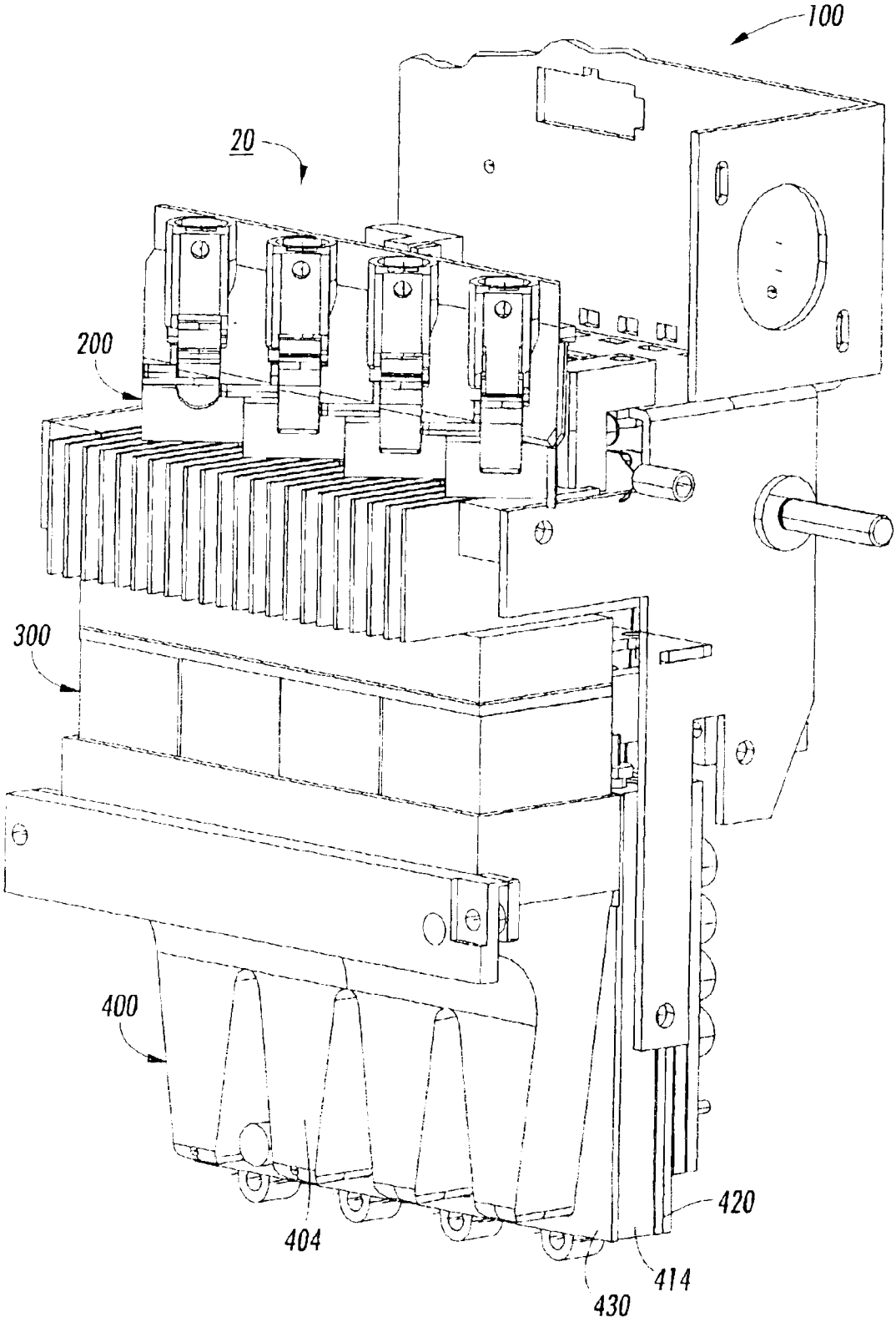
FIG. 5 is a perspective view of a solid phase change ink melting and supply system including a molten liquid ink storage and supply assembly and the high shear ball check valve of the flow control assembly of the present invention.
Figure 6:
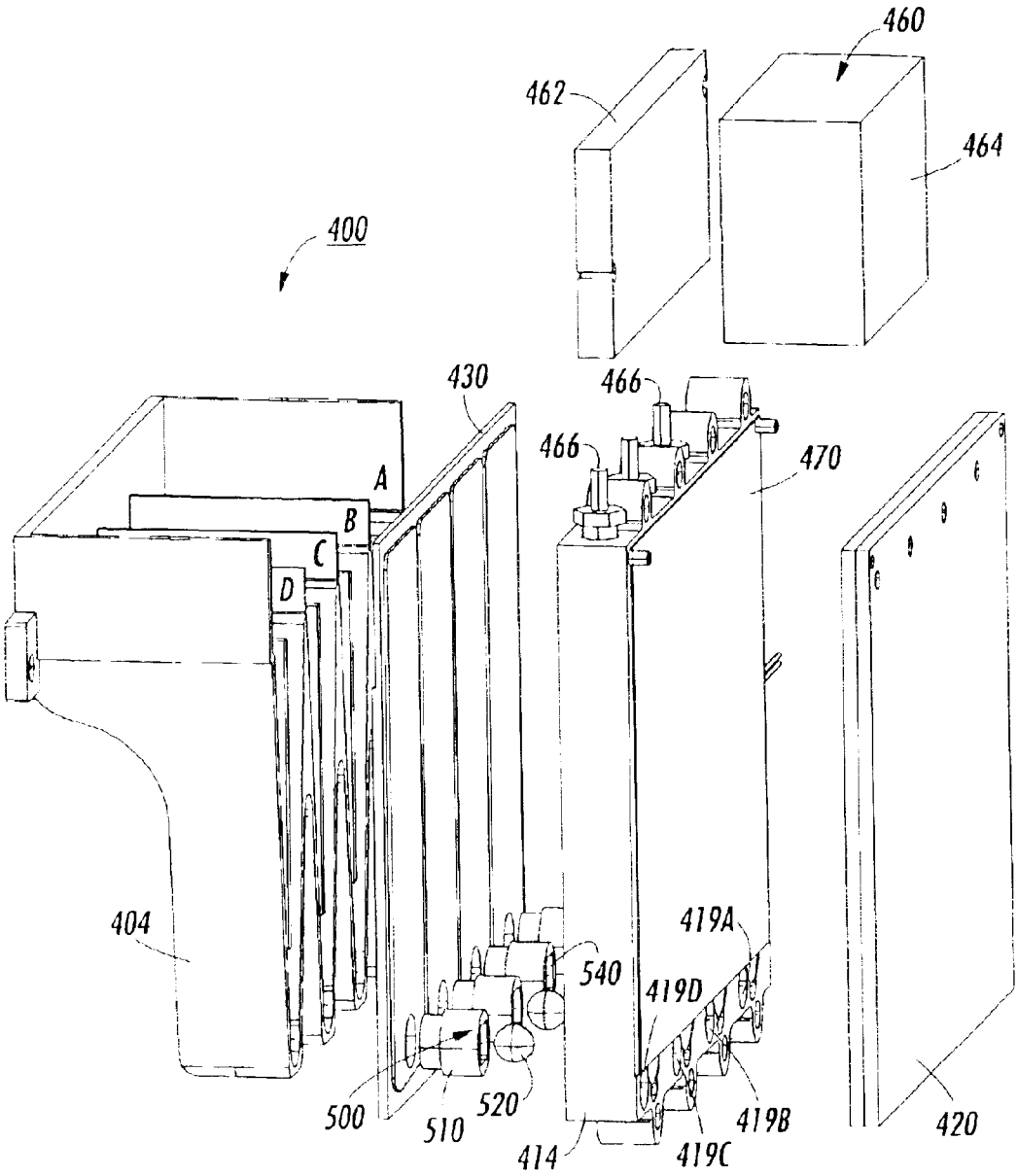
FIG. 6 is an exploded illustration of the lower portion of the molten liquid ink storage and supply assembly including the high shear ball check valve of the flow control assembly of the present invention.
Figure 7:
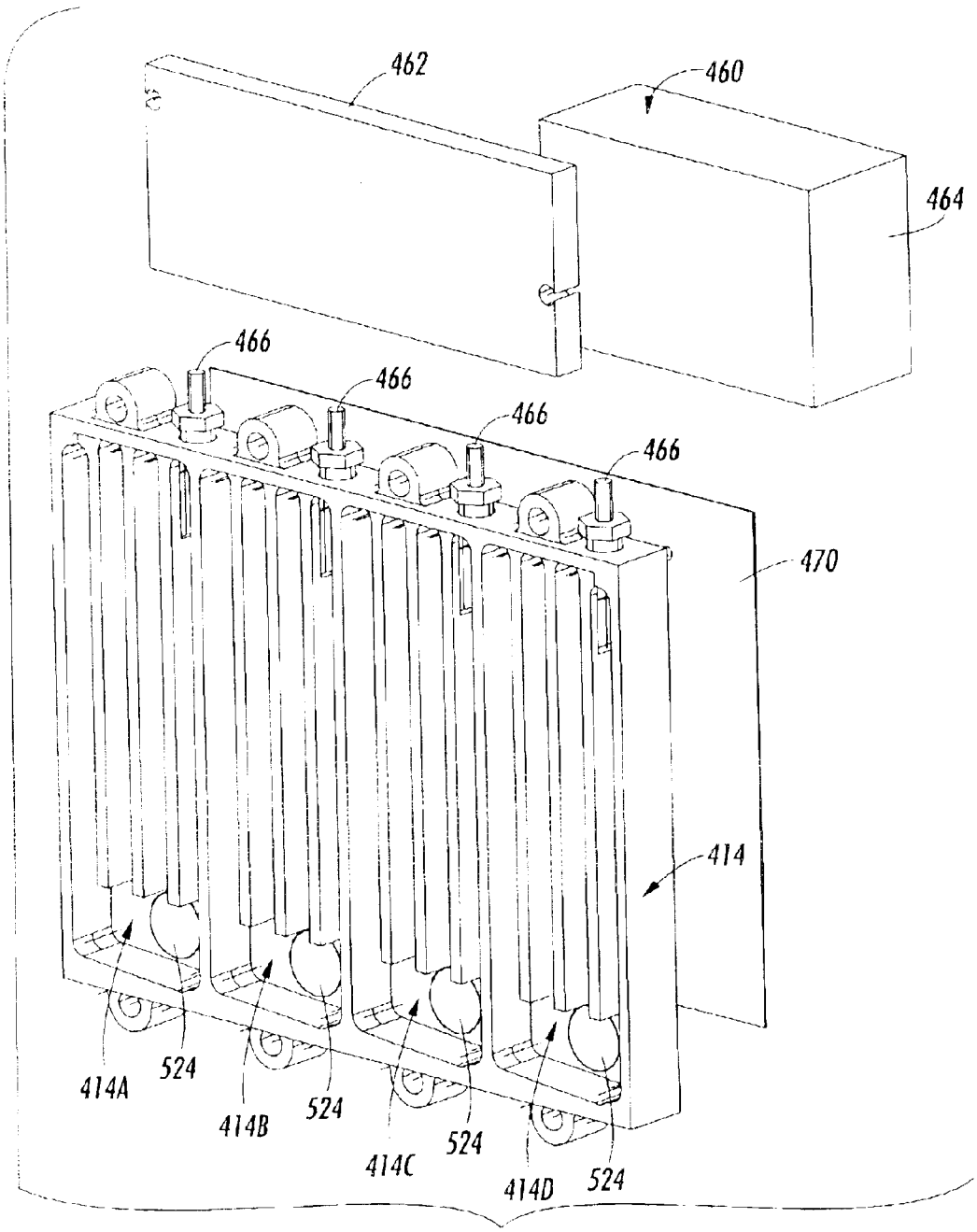
FIG. 7 a schematic illustration of the inside of the high pressure reservoir of the present invention.

Referring now to FIG. 5, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes the melting and control apparatus (FIG. 2) for melting or phase changing the solid form of the phase change ink into a liquid form, and then supplying the liquid form to a printhead system 30 including at least one printhead assembly 32. Since the phase change ink image producing machine or printer 10 is a high-speed, or high throughput, multicolor image producing machine, the printhead system includes four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

As can be seen, there has been provided a high shear ball check valve device is provided and is suitable for use in a liquid ink image producing machine to quickly and precisely control flow of liquid ink. The high shear ball check valve device includes a valve housing defining a valve chamber. The valve chamber has a desired cross-dimension, an inlet end, and an outlet end. The high shear ball check valve device also includes an inlet member that is connected to the valve housing and has an inlet opening and a ball seat and seal portion surrounding the inlet opening. The ball seat and seal portion has a desired first durometer hardness value. The high shear ball check valve device next includes a valve ball having a desired diameter and being located movably within the valve chamber, and an outlet opening located at the outlet end of the valve chamber. The outlet opening has a rectangular shape, and a size that is slightly greater than the diameter of the valve ball, for creating a backward fluid flow pattern that results in relatively high shear stress on the valve ball. The relatively high shear stress thereby quickly moving the valve ball away from the outlet opening and back against the ball seat and seal portion to shut off the inlet opening.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. A high shear ball check valve device comprising:

(a) a valve housing defining a valve chamber having a desired cross-dimension, an inlet end, and an outlet end;

(b) an inlet member connected to said valve housing, said inlet member including an inlet opening and a ball seat and seal portion surrounding said inlet opening and having a first desired durometer hardness value;

(c) a valve ball having a desired diameter and being located movably within said valve chamber; and (d) an outlet opening located at said outlet end of said valve chamber, said outlet opening having a rectangular shape and a size slightly greater than said diameter of said valve ball for creating a backward fluid flow pattern having relatively high shear stress on said valve ball, thereby quickly moving said valve ball away from said outlet opening and back against said ball seat and seal portion, shutting off said inlet opening.

2. The high shear ball check valve device of claim 1, wherein said valve chamber has a rectangular cross-section for creating high shear corner flow of a fluid from said Inlet end, around said valve ball, and through said outlet opening.

3. The high shear ball check valve device of claim 2, wherein said rectangular cross-section of said valve chamber is a square cross-section.

4. The high shear ball check valve device of claim 1, including a stop cap located downstream of said valve ball relative to fluid flow from said inlet end.

5. The high shear bail check valve device of claim 1, wherein said inlet member comprises a soft silicone rubber tube.

6. The high shear ball check valve device of claim 1, wherein said valve ball is made of a fluorocarbon material having a desired second durometer hardness value.

7. The high shear ball check valve device of claim 6, wherein said desired second durometer hardness value is greater than said desired first durometer harness value of said ball seat and seal portion.

8. A molten liquid ink flow control assembly for controlling flow of molten liquid ink, the molten liquid ink flow control assembly comprising:

(a) a first storage reservoir for storing a first quantity of a molten liquid ink;

(b) a second storage reservoir connected to said first storage reservoir for holding a second quantity of said molten liquid ink; and (e) flow control means for controlling flow of said molten liquid ink from said first storage reservoir into and through said second storage reservoir, said flow control means including back pressurization means for pressurizing said second storage reservoir, and a high shear ball check valve device mounted between said first storage reservoir and said second storage reservoir, said high shear bill check valve device including a valve housing, a valve ball located within said valve housing, and an outlet opening having a rectangular shape for creating a backward fluid flow pattern that results in relatively high shear stress on said valve ball, thereby quickly moving said valve ball from an open valve position to a closed valve position, and enabling quick and precise liquid ink flow control.

9. The molten liquid ink flow control assembly of claim 8, wherein said valve chamber has a rectangular cross-section for creating high shear corner flow of a fluid from said inlet end, around said valve ball, and through said outlet opening.

10. The molten liquid ink flow control assembly of claim 9, wherein said rectangular cross-section of said valve chamber is a square cross-section.

11. The molten liquid ink flow control assembly of claim 8, including a stop cap downstream of said valve ball relative to fluid flow from said inlet end.

12. The molten liquid ink flow control assembly of claim 8, wherein said inlet member comprises a soft silicone rubber tube.

13. The molten liquid ink flow control assembly of claim 8, wherein said valve ball is made of a fluorocarbon material having a desired second durometer hardness value.

14. The molten liquid ink flow control assembly of claim 13, wherein said desired second durometer hardness value is greater than said desired first durometer harness value of said ball seat and seal portion.

15. A phas change ink image producing machine comprising:

(a) a control subsystem for controlling operation of all subsystems and components of the image producing machine;

(b) a movable imaging member having an imaging surface;

(c) a printhead system connected to said control subsystem for ejecting drops of melted liquid phase change ink onto said imaging surface to form an image; and (d) a melter assembly for heating and melting said pieces of solid phase change ink to form molten liquid ink; and (e) a molten liquid ink flow control assembly for controlling flow of molten liquid ink, the molten liquid ink flow control assembly including:

(i) a first storage reservoir for storing a first quantity of molten liquid ink;

(ii) a second storage reservoir connected to said first storage reservoir for holding a second quantity of molten liquid ink; and (iii) flow control means for controlling flow of molten liquid ink from said first storage reservoir into and through said second storage reservoir, said flow control means including back pressurization means for pressurizing said second storage reservoir, and a high shear ball check valve device mounted between said first storage reservoir and said second storage reservoir, said high shear ball check valve device including a valve housing, a valve ball located within said valve housing, and an outlet opening having a rectangular shape for creating a backward fluid flow pattern that results in relatively high shear stress on said valve ball, thereby quickly moving said valve ball from an open valve position to a closed valve position, and enabling quick and precise liquid ink flow control.

16. The phase change ink image producing machine of claim 15, wherein said valve chamber has a rectangular cross-section for creating high shear corner flow of a fluid from said Inlet end, around said valve ball, and through said outlet opening.

17. The phase change ink image-producing machine of claim 16, wherein said rectangular cross-section of said valve chamber is a square cross-section.

18. The phase change ink image producing machine of claim 15 including a stop cap downstream of said valve ball relative to fluid flow from said inlet end.

19. The phase change ink image producing machine of claim 15, wherein said inlet member comprises a soft silicone rubber tube.

20. The phase change ink image producing machine of claim 15, wherein said valve ball is made of a fluorocarbon material having a desired second durometer hardness value.

* * * * *